US011011824B2

(12) United States Patent
Nishikawa et al.

(10) Patent No.: US 11,011,824 B2
(45) Date of Patent: May 18, 2021

(54) ANTENNA UNIT AND ELECTRONIC DEVICE

(71) Applicant: Panasonic Intellectual Property Management Co., Ltd., Osaka (JP)

(72) Inventors: Kenji Nishikawa, Hyogo (JP); Yu Ono, Miyagi (JP); Shingo Sumi, Miyagi (JP); Yasunori Komukai, Miyagi (JP); Yukinari Takahashi, Miyagi (JP); Toshiharu Ishimura, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 16/840,703

(22) Filed: Apr. 6, 2020

(65) Prior Publication Data

US 2020/0235460 A1 Jul. 23, 2020

Related U.S. Application Data

(60) Division of application No. 15/818,933, filed on Nov. 21, 2017, now Pat. No. 10,651,540, which is a (Continued)

(30) Foreign Application Priority Data

Feb. 18, 2016 (JP) ..... JP2016-029293

(51) Int. Cl.
*H01Q 1/24* (2006.01)
*H01Q 1/22* (2006.01)
(Continued)

(52) U.S. Cl.
CPC ..... *H01Q 1/2258* (2013.01); *H01Q 1/243* (2013.01); *H01Q 1/245* (2013.01); *H01Q 1/38* (2013.01);
(Continued)

(58) Field of Classification Search
CPC ..... H01Q 1/22–1/44; H01Q 1/48; H01Q 5/378–5/392
See application file for complete search history.

(56) References Cited

U.S. PATENT DOCUMENTS 4,835,538 A * 5/1989 McKenna ..... H01Q 9/0414 343/700 MS
7,079,079 B2 7/2006 Jo
(Continued)

FOREIGN PATENT DOCUMENTS

JP 2001-185947 A 7/2001
JP 2003-198410 A 7/2003
(Continued)

OTHER PUBLICATIONS

The Extended European Search Report dated Jan. 23, 2019 for the related European Patent Application No. 17752864.3.
(Continued)

*Primary Examiner* — Hasan Z Islam
(74) *Attorney, Agent, or Firm* — Renner, Otto, Boisselle & Sklar, LLP

(57) ABSTRACT

An antenna unit includes a plate-shaped dielectric substrate, as well as an antenna element and a stub element. The dielectric substrate has a first edge extending along a longitudinal direction of the dielectric substrate and a second edge extending along the longitudinal direction of the dielectric substrate, and the second edge is opposite to the first edge. The antenna element is disposed along the longitudinal direction of the dielectric substrate. The Antenna element has a first end containing a feedpoint and a second end containing an open end. The stub element is disposed between a section of the antenna element having a predetermined length containing the first end of the antenna element and the first edge of the dielectric substrate along the longitudinal direction of the dielectric substrate. The stub
(Continued)

element has a first end connected to a reference potential and a second end containing an open end.

7 Claims, 13 Drawing Sheets

Related U.S. Application Data continuation of application No. PCT/JP2017/001158, filed on Jan. 16, 2017.

(51) Int. Cl.

| | |
|---|---|
| ***H01Q 1/48*** | (2006.01) |
| ***H01Q 1/44*** | (2006.01) |
| ***H01Q 9/30*** | (2006.01) |
| ***H01Q 5/385*** | (2015.01) |
| ***H01Q 9/42*** | (2006.01) |
| ***H01Q 1/38*** | (2006.01) |
| ***H01Q 7/00*** | (2006.01) |
| ***H01Q 9/04*** | (2006.01) |

(52) U.S. Cl.

CPC ..... *H01Q 1/44* (2013.01); *H01Q 1/48* (2013.01); *H01Q 5/385* (2015.01); *H01Q 7/00* (2013.01); *H01Q 9/0421* (2013.01); *H01Q 9/30* (2013.01); *H01Q 9/42* (2013.01)

(56) References Cited

U.S. PATENT DOCUMENTS

| | | | | |
|---|---|---|---|---|
| 10,224,630 | B2 * | 3/2019 | Iellci | H01Q 5/314 |
| 2001/0005181 | A1 | 6/2001 | Desclos | |
| 2003/0063032 | A1 | 4/2003 | Usui | |
| 2004/0066341 | A1 | 4/2004 | Ito et al. | |
| 2004/0108957 | A1 * | 6/2004 | Umehara | H01Q 1/243 343/700 MS |
| 2005/0017912 | A1 | 1/2005 | Azoulay | |
| 2006/0176226 | A1 | 8/2006 | Moon et al. | |
| 2007/0229366 | A1 | 10/2007 | Kim | |
| 2009/0073059 | A1 | 3/2009 | Ikegaya | |
| 2012/0092220 | A1 | 4/2012 | Tani et al. | |
| 2012/0299781 | A1 | 11/2012 | Lee | |
| 2013/0271329 | A1 | 10/2013 | Sato | |
| 2014/0078001 | A1 | 3/2014 | Matsuoka et al. | |
| 2014/0162572 | A1 | 6/2014 | Hirabayashi | |
| 2014/0300517 | A1 | 10/2014 | Onaka | |
| 2015/0022417 | A1 | 1/2015 | Pan | |
| 2015/0171518 | A1 | 6/2015 | Lee | |
| 2015/0288074 | A1 | 10/2015 | Harper et al. | |

FOREIGN PATENT DOCUMENTS

| | | | |
|---|---|---|---|
| JP | 2006-217631 | A | 8/2006 |
| JP | 2007-202195 | A | 8/2007 |
| JP | 1792173 | B2 | 10/2011 |
| JP | 5301608 | B2 | 9/2013 |
| JP | 2013-223004 | A | 10/2013 |
| JP | 2013-247645 | A | 12/2013 |
| JP | 2014-116883 | A | 6/2014 |
| JP | 2015-046790 | A | 3/2015 |
| TW | 200729612 | A | 8/2007 |
| WO | 2005-062422 | A1 | 7/2005 |

OTHER PUBLICATIONS

Allowed Claims from Parent U.S. Appl. No. 15/818,933, filed Nov. 21, 2017.

International Search Report for corresponding International Application No. PCT/JP2017/001158 dated Mar. 14, 2017.

* cited by examiner

ANTENNA UNIT AND ELECTRONIC DEVICE

This application is a divisional of U.S. application Ser. No. 15/818,933, filed Nov. 21, 2017, which is a continuation of International Application No. PCT/JP2017/001158, filed Jan. 16, 2017, the entire disclosures of which are incorporated herein by reference.

TECHNICAL FIELD

The present disclosure relates to an antenna unit for an electronic device that serves as a portable wireless communication tool. The present disclosure relates to an electronic device equipped with such an antenna unit.

BACKGROUND ART

PTLs 1 to 3 each disclose an antenna unit for an electronic device that serves as a portable wireless communication tool, for example.

CITATION LIST

Patent Literature

PTL 1: Japanese Patent No. 4792173
PTL 2: Japanese Patent No. 5301608
PTL 3: Unexamined Japanese Patent Publication No. 2014-116883

SUMMARY

An antenna unit according to an aspect of the present disclosure includes a plate-shaped dielectric substrate, as well as an antenna element and a stub element that are provided on the dielectric substrate. The dielectric substrate has a first edge extending along a longitudinal direction of the dielectric substrate and a second edge extending along the longitudinal direction of the dielectric substrate, and the second edge is opposite to the first edge. The antenna element is disposed along the longitudinal direction of the dielectric substrate. The antenna element has a first end containing a feedpoint and a second end containing an open end. The stub element is disposed between a section of the antenna element of a predetermined length containing the first end of the antenna element and the first edge of the dielectric substrate along the longitudinal direction of the dielectric substrate. The stub element has a first end connected to a reference potential and a second end containing an open end.

DESCRIPTION OF EMBODIMENTS

Figure 1:
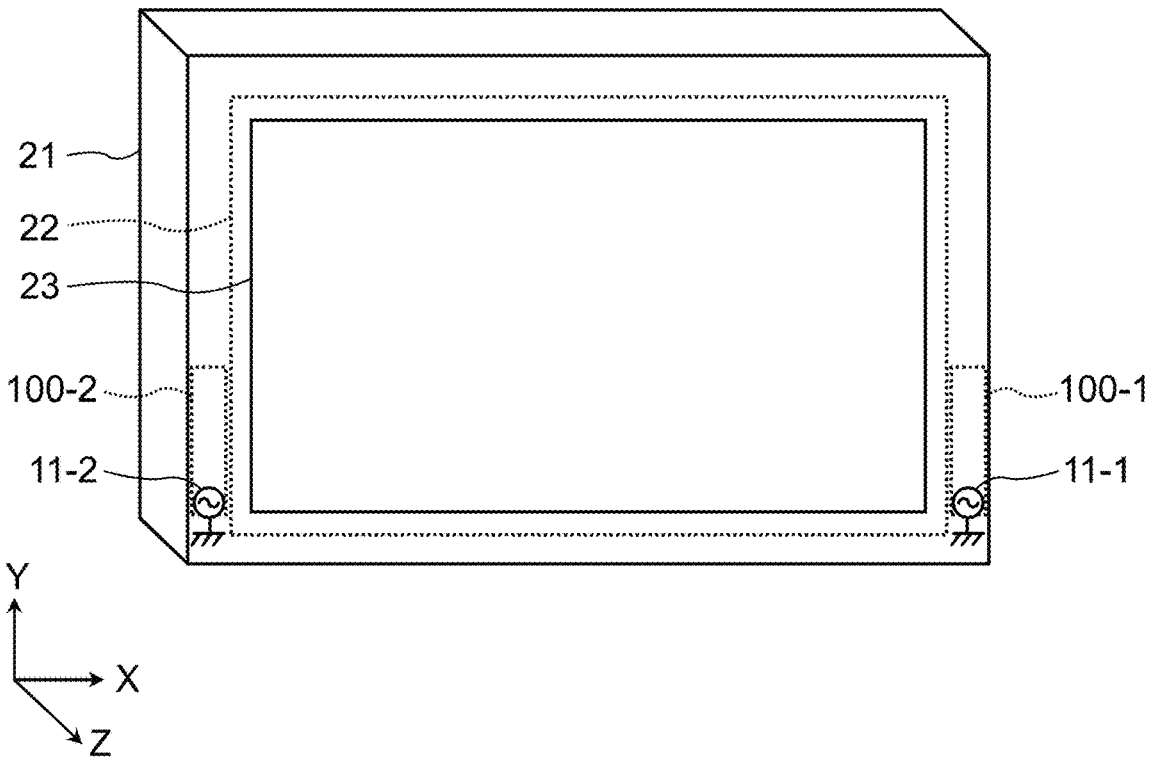
FIG. 1 is a perspective view of an electronic device according to a first exemplary embodiment.

Exemplary embodiments of the present disclosure will now be described in detail with reference to the accompanying drawings. However, description in more detail than is necessary can be omitted. For example, detailed descriptions of well-known matters and redundant descriptions of substantially identical structural elements are omitted so as to avoid unnecessarily redundant description and enable those of skill in the art to readily understand the exemplary embodiments herein.

The inventor(s) have provided the accompanying drawings and the following description to allow those skilled in the art to fully understand the present disclosure. Accordingly, these examples should not be construed to limit the spirit and scope of the appended claims.

The exemplary embodiments will be described with reference to XYZ Cartesian coordinates shown on the drawings.

In the drawings, structural elements indicated by the same reference numerals have substantially identical functions even if the shapes, dimensions, or other particulars thereof are different.

1. First Exemplary Embodiment

Hereinafter, with reference to FIGS. 1 to 5, an antenna unit and an electronic device according to a first exemplary embodiment will now be described.

1-1. Configuration

Figure 2:
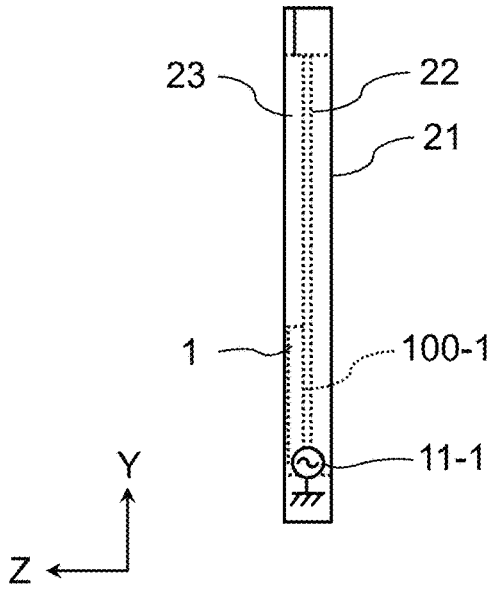
FIG. 2 is a side view of the electronic device of FIG. 1.

FIG. 1 is a perspective view of an electronic device according to the first exemplary embodiment. FIG. 2 is a side view of the electronic device of FIG. 1. The electronic device of FIG. 1 has a casing including outer casing 21 and metallic chassis 22 and one or more (two in the example of FIG. 1) antenna units 100-1, 100-2. The electronic device of FIG. 1 is a tablet-type electronic device equipped with touch-panel display 23.

Outer casing 21 is made from a dielectric and houses components of the electronic device inside. Metallic chassis 22 is made from a conductor and is disposed inside outer casing 21. In the present specification, outer casing 21 and metallic chassis 22 are also referred to as an "outer casing segment" and an "inner casing segment", respectively. Outer casing 21 of the electronic device has a first surface and a second surface that are opposite to each other. The electronic device includes display 23 provided on the first surface of outer casing 21. Hereafter, the first surface of outer casing 21 (at a positive side in the Z-direction in FIG. 1) is referred to as a "front surface", and the second surface of outer casing 21 (at a negative side in the Z-direction in FIG. 1) is referred to as a "rear surface".

Antenna units 100-1, 100-2 are connected to high-frequency signal sources 11-1, 11-2, respectively.

Hereinafter, antenna units 100-1, 100-2 of FIG. 1 are collectively called "antenna unit 100". High-frequency signal sources 11-1, 11-2 of FIG. 1 are collectively called "high-frequency signal source 11".

Figure 3:
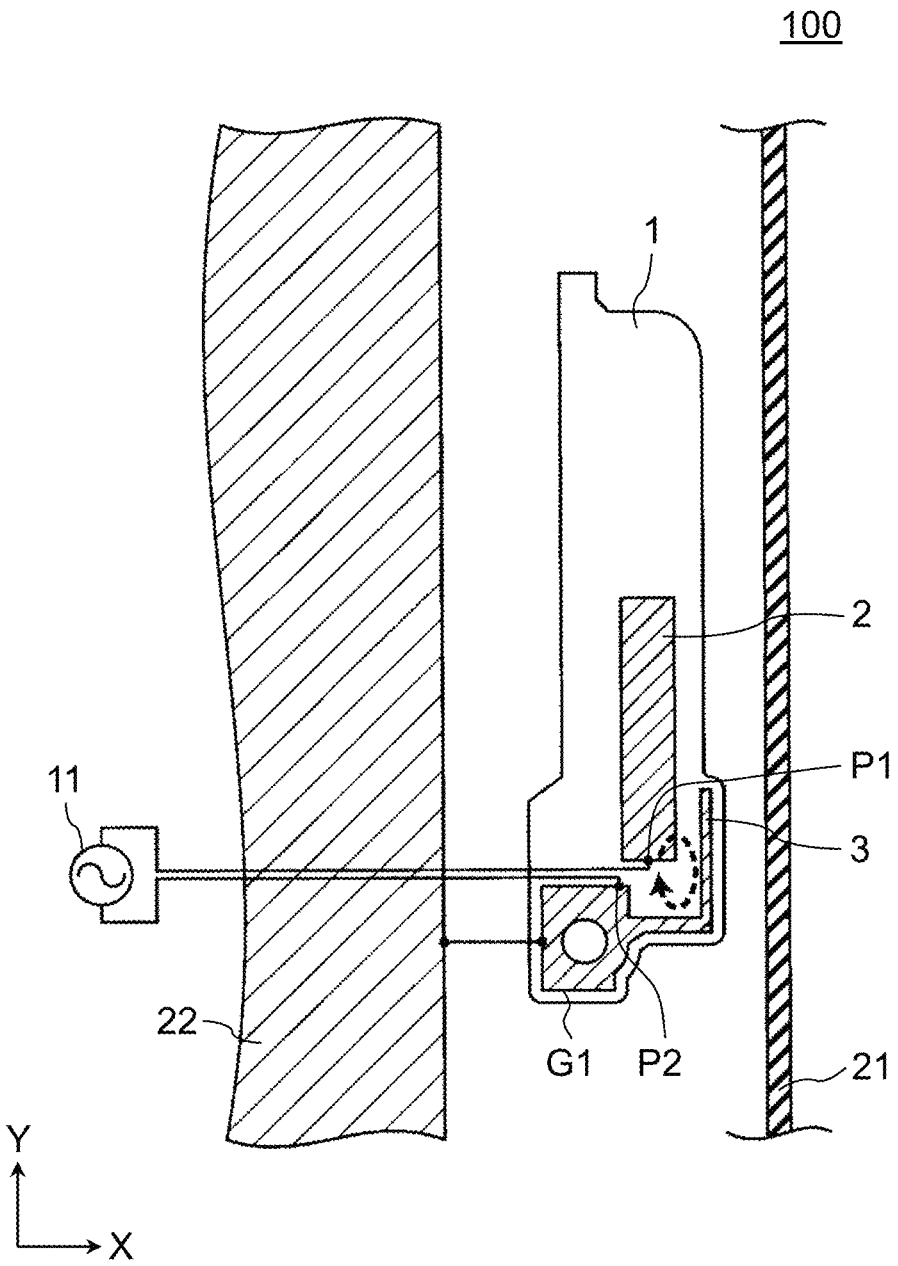
FIG. 3 is a plan view illustrating a configuration of antenna unit 100 in FIG. 1.

FIG. 3 is a plan view illustrating a configuration of antenna unit 100 in FIG. 1. Antenna unit 100 includes plate-shaped dielectric substrate 1, as well as antenna element 2, stub element 3, and ground conductor G1 that are provided on dielectric substrate 1. Dielectric substrate 1 extends longitudinally along the Y-axis in FIG. 3. Dielectric substrate 1 has a first longitudinally extending edge (at a positive side in the X-direction in FIG. 3) and a second longitudinally extending edge (at a negative side in the X-direction in FIG. 3) opposite to the first edge. Antenna element 2 is disposed along the longitudinal direction of dielectric substrate 1. Antenna element 2 has a first end containing feedpoint P1 (at a negative side in the Y-direction in FIG. 3) and a second end containing an open end (at a positive side in the Y-direction in FIG. 3). Ground conductor G1 is disposed so as to face the first end of antenna element 2. Ground conductor G1 is electrically connected to metallic chassis 22. Feedpoint P1 and connection point P2 on ground conductor G1 are each connected to high-frequency signal source 11 via a feed line, e.g. coaxial cable. An inner conductor of the feed line is connected to feedpoint P1 of antenna element 2, whereas an outer conductor of the feed line is connected to connection point P2. Antenna unit 100 is fed with power in an unbalanced state via the feed line. Stub element 3 is disposed between a section of antenna element 2 having a predetermined length containing the first end of antenna element 2 (i.e. a section in a vicinity of feedpoint P1) and the first edge of dielectric substrate 1 along the longitudinal direction of dielectric substrate 1. Stub element 3 has a first end connected to ground conductor G1 (i.e. a reference potential) and a second end containing an open end.

Stub element 3 has an electrical length that is less than one quarter of a wavelength at which the antenna unit operates and is shorter than an electrical length of antenna element 2. Antenna element 2 and stub element 3 are disposed such that a high-frequency current (denoted by a dotted line in FIG. 3) flows in a loop around a region between antenna element 2 and stub element 3 while antenna unit 100 is operating at a resonance frequency for antenna element 2.

Antenna unit 100 is disposed such that the first edge of dielectric substrate 1 faces outer casing 21 and the second edge of dielectric substrate 1 faces metallic chassis 22.

With reference to FIG. 2, dielectric substrate 1 may be closer to the front surface than to the rear surface of the casing. Dielectric substrate 1 may be disposed on a surface that is substantially identical to a display surface of display 23.

1-2. Operation

Decrease in the specific absorption rate (SAR) for antenna unit 100 of FIG .3 will now be described.

Electronic devices that serve as portable wireless communication tools are used near the human body. As a result, some radiation power from the antenna of the device is absorbed by the human body. The SAR is a measure of the amount of this absorption and is represented by the following equation (1) using electrical conductivity a, density p, and magnetic field intensity E.

$$SAR=\sigma/(2\rho)\times|E|^{12} \quad (1)$$

Figure 4:
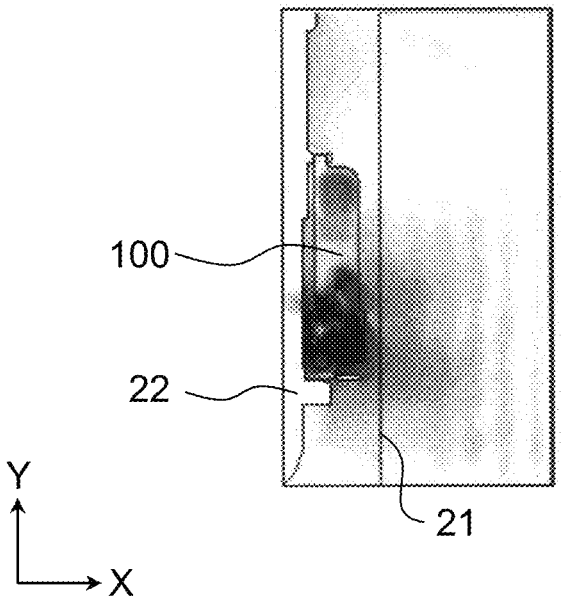
FIG. 4 is a graph illustrating magnetic field intensities in a vicinity of antenna unit 100 of FIG. 3.
Figure 5:
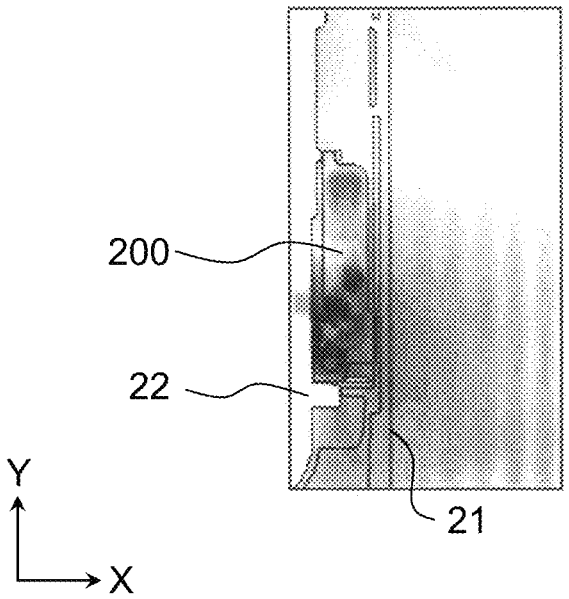
FIG. 5 is a graph illustrating magnetic field intensities in a vicinity of antenna unit 200 according to a first comparative example.

FIG. 4 is a graph illustrating magnetic field intensities in a vicinity of antenna unit 100 of FIG. 3. FIG. 5 is a graph illustrating magnetic field intensities in a vicinity of antenna unit 200 according to a first comparative example. Antenna unit 200 in FIG. 5 is equivalent to antenna unit 100 of FIG. 3 except that antenna unit 200 has no stub element 3. Similarly to antenna unit 100 of FIG. 3, antenna unit 200 in FIG. 5 includes plate-shaped dielectric substrate 1, as well as antenna element 2 and ground conductor G1 that are provided on dielectric substrate 1. Similarly to antenna unit 100 of FIG. 3, antenna unit 200 in FIG. 5 is disposed inside a casing that includes outer casing 21 and metallic chassis 22. In the graphs of FIGS. 4 and 5, color shades represent differences in magnetic field intensity. According to the equation (1), the differences in magnetic field intensity are associated with variations in SAR value.

With reference to FIGS. 4 and 5, antenna unit 100 of FIG. 3 is equipped with stub element 3 and thus allows a high-frequency current to flow in a loop around a region between antenna element 2 and stub element 3, leading to high magnetic field intensities in this region. This configuration in turn enables the magnetic field intensity, i.e. radiation power, to decrease sharply with an increase in distance from antenna unit 100 in the positive X-direction. The decrease in magnetic field intensity reduces the occurrence of a rise in SAR in an area beyond antenna unit 100 in the positive X-direction, especially an area outside outer casing 21.

The occurrence of a rise in SAR can be reduced by disposing dielectric substrate 1 closer to the front surface than to the rear surface of the casing. If an electronic device is equipped with display 23, the rear surface of the electronic device is presumably held by a user's hand or other body part while the device is in use. Consequently, the necessity to reduce the occurrence of a rise in SAR is greater at the rear surface than at the front surface of the electronic device. Magnetic field intensity E is in inverse proportion to distance. Thus, according to the equation (1), the SAR comes down with an increase in distance between the antenna and the human body. The occurrence of a rise in SAR can be reduced at the rear surface of the electronic device of FIG. 1 by disposing dielectric substrate 1 closer to the front surface than to the rear surface of the casing. In particular, if dielectric substrate 1 is disposed on a surface that is substantially identical to the display surface of display 23, an effect in reducing the occurrence of a rise in SAR at the rear surface of the electronic device is maximized.

1-3. Effects and Others

Antenna unit 100 according to the first exemplary embodiment includes plate-shaped dielectric substrate 1, as well as antenna element 2 and stub element 3 that are provided on dielectric substrate 1. Dielectric substrate 1 has the first longitudinally extending edge and the second longitudinally extending edge opposite to the first edge. Antenna element 2 is disposed along the longitudinal direction of dielectric substrate 1. Antenna element 2 has the first end containing feedpoint P1 and the second end containing an open end. Stub element 3 is disposed between a section of antenna element 2 having the predetermined length containing the first end of antenna element 2 and the first edge of dielectric substrate 1 along the longitudinal direction of dielectric substrate 1. Stub element 3 has the first end connected to the reference potential and the second end containing an open end.

In antenna unit 100 according to the first exemplary embodiment, the electrical length of stub element 3 may be less than one quarter of a wavelength at which the antenna unit operates and may be shorter than the electrical length of antenna element 2. Antenna element 2 and stub element 3 may be disposed such that the high-frequency current flows in a loop around a region between antenna element 2 and stub element 3 while antenna unit 100 is operating at a resonance frequency for antenna element 2.

If a tablet-type electronic device includes an antenna unit provided somewhere around a display according to the first exemplary embodiment, the occurrence of a rise in SAR can be reduced in a lateral direction of the electronic device.

The electronic device according to the first exemplary embodiment includes the casing and at least one antenna unit 100. The casing includes an outer casing segment made from a dielectric and an inner casing segment that is disposed inside the outer casing segment and is made from a conductor. At least one antenna unit 100 is each disposed such that the first edge of dielectric substrate 1 faces the outer casing segment and the second edge of dielectric substrate 1 faces the inner casing segment.

In the electronic device according to the first exemplary embodiment, the casing may have a first surface and a second surface that are opposite to each other. The electronic device may further include display 23 provided on the first surface of the casing. Dielectric substrate 1 may be closer to the first surface of the casing than to the second surface of the casing.

In the electronic device according to the first exemplary embodiment, dielectric substrate 1 may be disposed on a surface that is substantially identical to the display surface of display 23.

The electronic device according to the first exemplary embodiment can reduce the occurrence of a rise in SAR in the lateral direction. The occurrence of a rise in SAR can be reduced at the rear surface of the electronic device in the first exemplary embodiment by disposing dielectric substrate 1 closer to the first surface of the casing than to the second surface of the casing.

2. Second Exemplary Embodiment

Hereinafter, with reference to FIGS. 6 to 9, an electronic device according to a second exemplary embodiment will now be described.

2-1. Configuration

Figure 6:
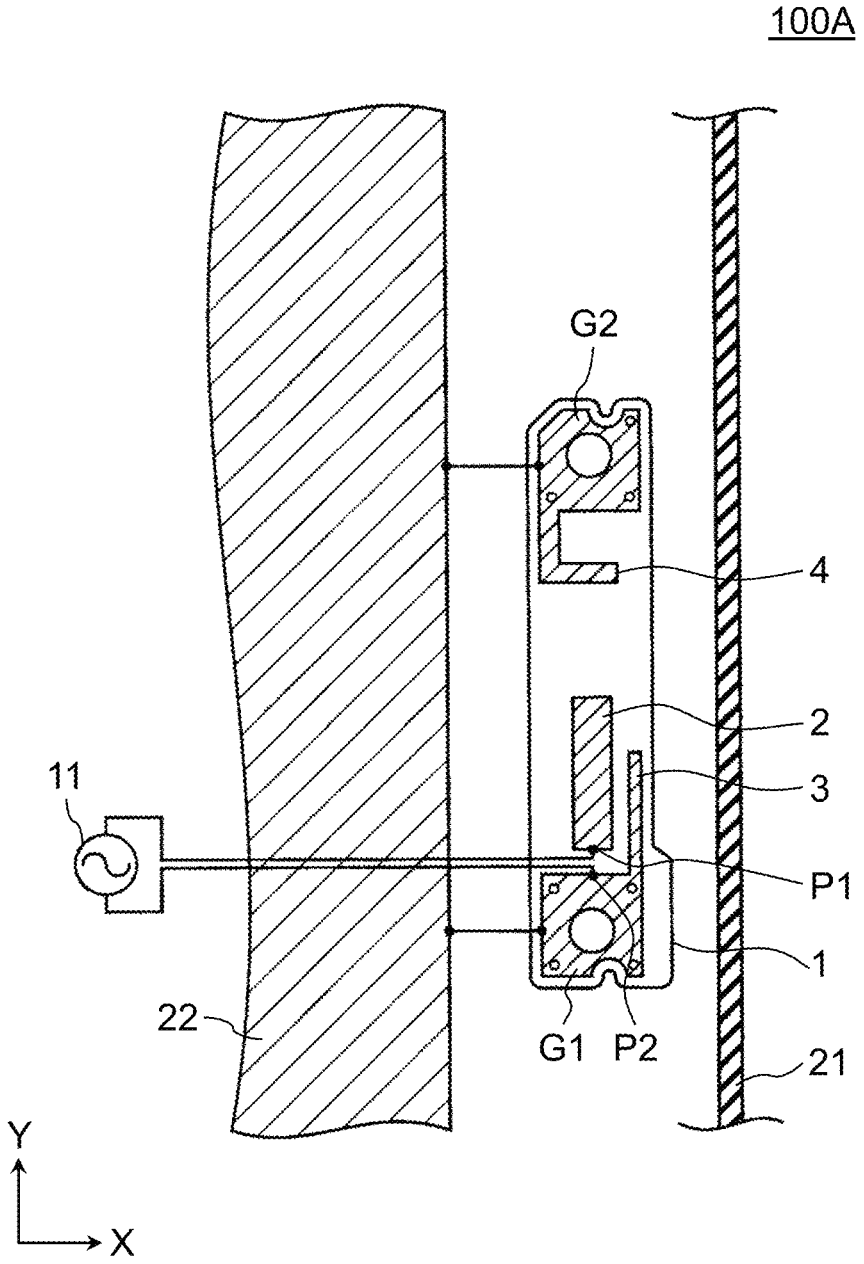
FIG. 6 is a plan view illustrating a configuration of antenna unit 100A according to a second exemplary embodiment.

FIG. 6 is a plan view illustrating a configuration of antenna unit 100A according to the second exemplary embodiment. Antenna unit 100A includes plate-shaped dielectric substrate 1, as well as antenna element 2, stub element 3, ground element 4 and ground conductors G1, G2 that are provided on dielectric substrate 1. Antenna unit 100A is substantially equivalent to antenna unit 100 of FIG. 3 further including ground element 4 and ground conductor G2.

Ground conductor G2 is disposed so as to face a second end (an open end) of antenna element 2. Ground conductor G2 is electrically connected to metallic chassis 22.

Ground element 4 is a grounded "passive element". Ground element 4 has a first end connected to ground conductor G2 (i.e. a reference potential) and a second end containing an open end. A section of ground element 4 having a predetermined length containing the second end of ground element 4 is disposed so as to face the second end (the open end) of antenna element 2 and to be electromagnetically coupled to the second end of antenna element 2. Ground element 4 is disposed relative to antenna element 2 such that the first end of ground element 4 is remoter from feedpoint P1 than the second end of ground element 4.

Ground element 4 resonates at a frequency within an operating frequency band for antenna element 2 or at a frequency within a frequency band adjacent to the operating frequency band for antenna element 2.

2-2. Operation

Figure 7:
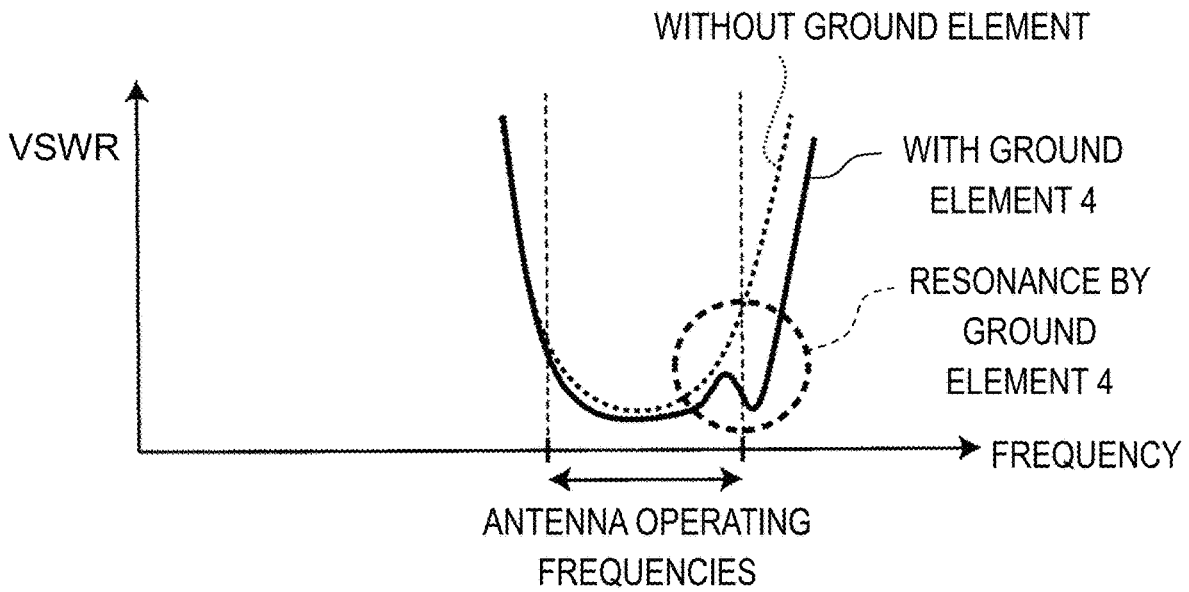
FIG. 7 is a schematic graph illustrating a profile of voltage standing wave ratio (VSWR) versus frequency of the antenna unit of FIG. 6.

FIG. 7 is a schematic graph illustrating a profile of VSWR versus frequency of the antenna unit of FIG. 6. The SAR is high in a vicinity of an area where high-frequency currents crowd on a conductor. In particular, since wavelength decreases with an increase in frequency, currents crowd in a small area on a conductor, and the SAR is high especially in the vicinity of the area. Generally, electric power tends to be locally concentrated in high-frequency bands (e.g. the 5 GHz band), which are used by communications in wireless local area networks (WLANs). Decreasing the SAR in these frequency bands is difficult. Because of this, ground element 4 in antenna unit 100A is configured to resonate at a high frequency within the operating frequency band for antenna element 2 or at a frequency within a high-frequency band adjacent to the operating frequency band for antenna element 2.

When antenna element 2 is under excitation at a resonance frequency for ground element 4, a high-frequency current flows from feedpoint P1 to antenna element 2 and then flows to ground element 4 by means of electromagnetic coupling between antenna element 2 and ground element 4. The high-frequency current that has flowed to ground element 4 flows to ground conductor G2 and metallic chassis 22. As described above, ground element 4 is disposed relative to antenna element 2 such that one of the ends of ground element 4 is remote from feedpoint P1. This configuration enables the high-frequency current to flow from feedpoint P1 to the remote end of ground element 4 and thus distributes the high-frequency current to a wider range than another configuration without ground element 4. The antenna unit in this exemplary embodiment allows the high-frequency current to flow to ground element 4, ground conductor G2, and metallic chassis 22, and thereby lowers the level of current crowding on antenna element 2 and limits a rise in SAR more effectively than antenna unit 100 in the first exemplary embodiment.

Figure 8:
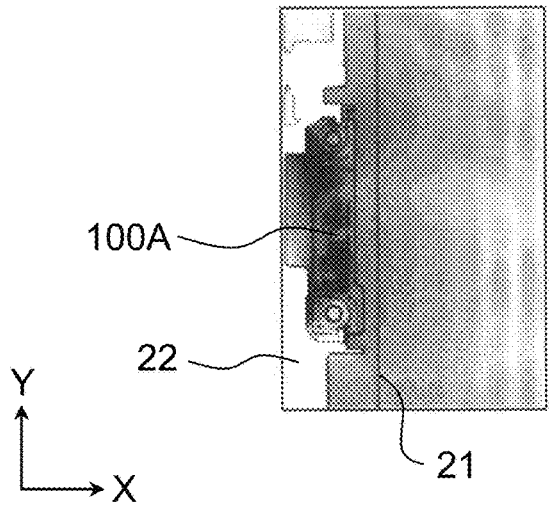
FIG. 8 is a graph illustrating magnetic field intensities in a vicinity of antenna unit 100A of FIG. 6.
Figure 9:
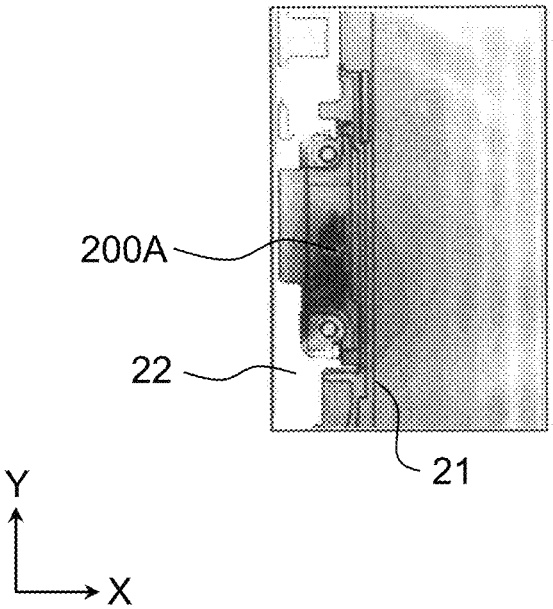
FIG. 9 is a graph illustrating magnetic field intensities in a vicinity of antenna unit 200A according to a second comparative example.

FIG. 8 is a graph illustrating magnetic field intensities in a vicinity of antenna unit 100A of FIG. 6. FIG. 9 is a graph illustrating magnetic field intensities in a vicinity of antenna unit 200A according to a second comparative example. Antenna unit 200A in FIG. 9 is equivalent to antenna unit 100A of FIG. 6 except that antenna unit 200A has no ground element 4. Similarly to antenna unit 100A of FIG. 6, antenna unit 200A in FIG. 8 includes plate-shaped dielectric substrate 1, as well as antenna element 2, stub element 3, and ground conductors G1, G2 that are provided on dielectric substrate 1. Similarly to antenna unit 100A of FIG. 6, antenna unit 200A in FIG. 8 is disposed inside a casing that includes outer casing 21 and metallic chassis 22.

With reference to FIGS. 8 and 9, antenna unit 100A of FIG. 6 is equipped with ground element 4, and thereby lowers the level of current crowding on antenna element 2 and limits a rise in SAR. Antenna unit 100A can limit a rise in SAR while maintaining overall radiation power from antenna unit 100A.

2-3. Effects and Others

Antenna unit 100A in the second exemplary embodiment includes ground element 4 that is additionally provided on dielectric substrate 1. Ground element 4 has the first end connected to the reference potential and the second end containing an open end. Ground element 4 is disposed such that a section of ground element 4 having the predetermined length containing the second end of ground element 4 faces the second end of antenna element 2. Ground element 4 resonates at a frequency within an operating frequency band for antenna element 2 or at a frequency within a frequency band adjacent to the operating frequency band for antenna element 2.

Antenna unit 100A according to the second exemplary embodiment can limit a rise in SAR even during operation at high frequencies. In particular, if a tablet-type electronic device includes the antenna unit provided somewhere around a display, the occurrence of a rise in SAR can be reduced in a lateral direction of the electronic device.

In antenna unit 100A according to the second exemplary embodiment, ground element 4 is configured to resonate and contribute to power radiation. This enables antenna unit 100A to cover a wide frequency band.

3. Third Exemplary Embodiment

Hereinafter, with reference to FIGS. 10 and 11, an electronic device according to a third exemplary embodiment will now be described.

3-1. Configuration

Figure 10:
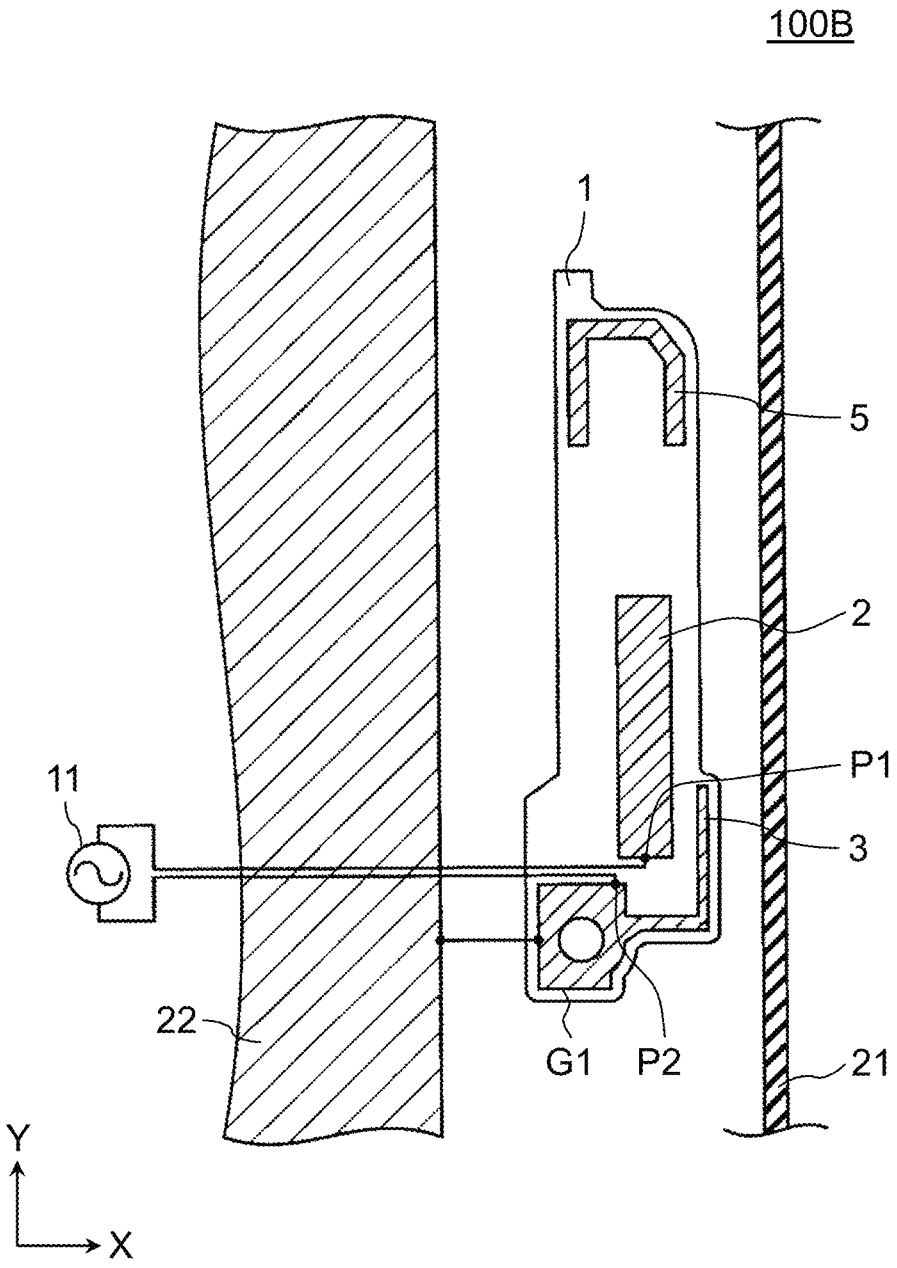
FIG. 10 is a plan view illustrating a configuration of antenna unit 100B according to a third exemplary embodiment.

FIG. 10 is a plan view illustrating a configuration of antenna unit 100B according to the third exemplary embodiment. Antenna unit 100B includes plate-shaped dielectric substrate 1, as well as antenna element 2, stub element 3, parasitic element 5 and ground conductor G1 that are provided on dielectric substrate 1. Antenna unit 100B is substantially equivalent to antenna unit 100 of FIG. 3 further including parasitic element 5.

Parasitic element 5 is an ungrounded "passive element". Parasitic element 5 is disposed such that at least part of parasitic element 5 faces a second end (an open end) of antenna element 2 and is electromagnetically coupled to the second end of antenna element 2. Parasitic element 5 may form a U-shaped bent pattern on dielectric substrate 1. Both ends of parasitic element 5 may be closer to the second end of antenna element 2 than a middle section of parasitic element 5 is. Parasitic element 5 has no electrical connection with other conductors such as ground conductor G1 and metallic chassis 22.

Parasitic element 5 resonates at a frequency within an operating frequency band for antenna element 2 or at a frequency within a frequency band adjacent to the operating frequency band for antenna element 2.

3-2. Operation

Figure 11:
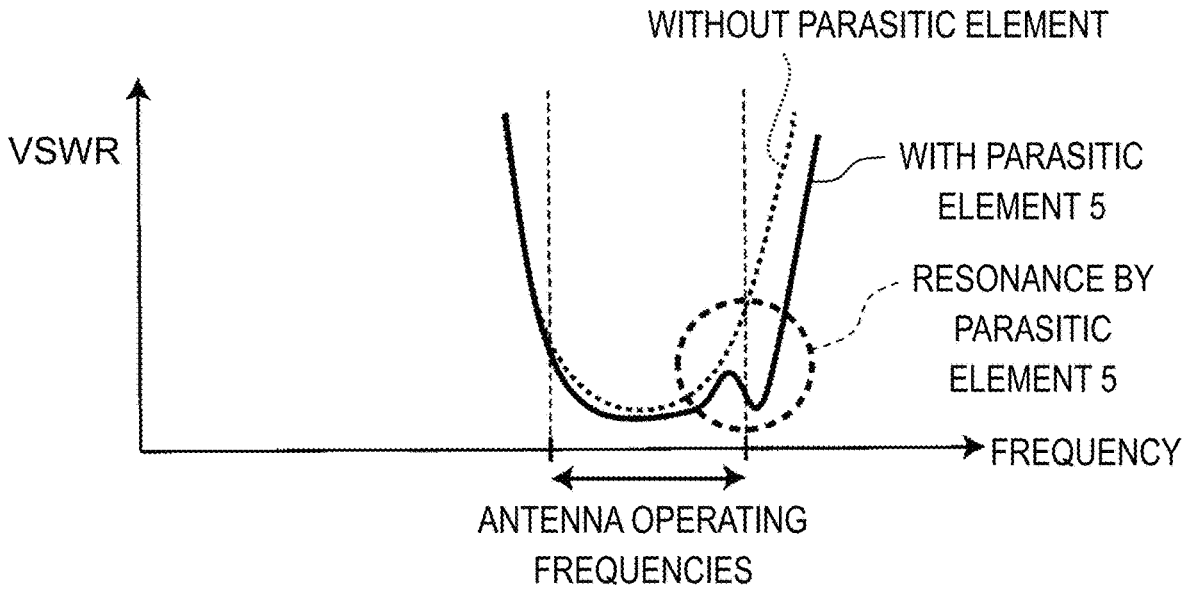
FIG. 11 is a schematic graph illustrating a profile of VSWR versus frequency of the antenna unit of FIG. 10.

FIG. 11 is a schematic graph illustrating a profile of VSWR versus frequency of the antenna unit of FIG. 10. Parasitic element 5 in antenna unit 100B is configured to resonate at a high frequency within the operating frequency band for antenna element 2 or at a frequency within a high-frequency band adjacent to the operating frequency band for antenna element 2.

When antenna element 2 is under excitation at a resonance frequency for parasitic element 5, a high-frequency current flows from feedpoint P1 to antenna element 2 and then flows to parasitic element 5 by means of electromagnetic coupling between antenna element 2 and parasitic element 5. This configuration enables the high-frequency current to flow from feedpoint P1 to a remote end of parasitic element 5 and thus distributes the high-frequency current to a wider range than another configuration without parasitic element 5. The antenna unit in this exemplary embodiment allows the high-frequency current to flow to parasitic element 5 and thereby lowers the level of current crowding on antenna element 2 and limits a rise in SAR more effectively than antenna unit 100 in the first exemplary embodiment. Antenna unit 100B can limit a rise in SAR while maintaining overall radiation power from antenna unit 100B.

3-3. Effects and Others

Antenna unit 100B in the third exemplary embodiment includes parasitic element 5 that is additionally provided on dielectric substrate 1. Parasitic element 5 is disposed such that at least part of parasitic element 5 faces the second end of antenna element 2. Parasitic element 5 has no electrical connection with other conductors. Parasitic element 5 resonates at a frequency within an operating frequency band for antenna element 2 or at a frequency within a frequency band adjacent to the operating frequency band for antenna element 2.

In antenna unit 100B according to the third exemplary embodiment, parasitic element 5 may take the form of a U-shaped bent strip on dielectric substrate 1. In this case, both ends of parasitic element 5 are closer to the second end of antenna element 2 than a middle section of parasitic element 5 is.

Antenna unit 100B in the third exemplary embodiment can reduce the occurrence of a rise in SAR even during operation at high frequencies. In particular, if a tablet-type electronic device includes the antenna unit provided somewhere around a display, the electronic device can limit a rise in SAR in its lateral direction.

According to antenna unit 100B in the third exemplary embodiment, U-shaped bent parasitic element 5 contributes to increased electromagnetic coupling between antenna element 2 and parasitic element 5. This configuration facilitates flow of the high-frequency current between antenna element 2 and parasitic element 5, resulting in distributed electric current.

In antenna unit 100B according to the third exemplary embodiment, parasitic element 5 is configured to resonate and contribute to power radiation. This enables antenna unit 100B to cover a wide frequency band.

4. Fourth Exemplary Embodiment

Hereinafter, with reference to FIG. 12, an electronic device according to a fourth exemplary embodiment will now be described.

4-1. Configuration

Figure 12:
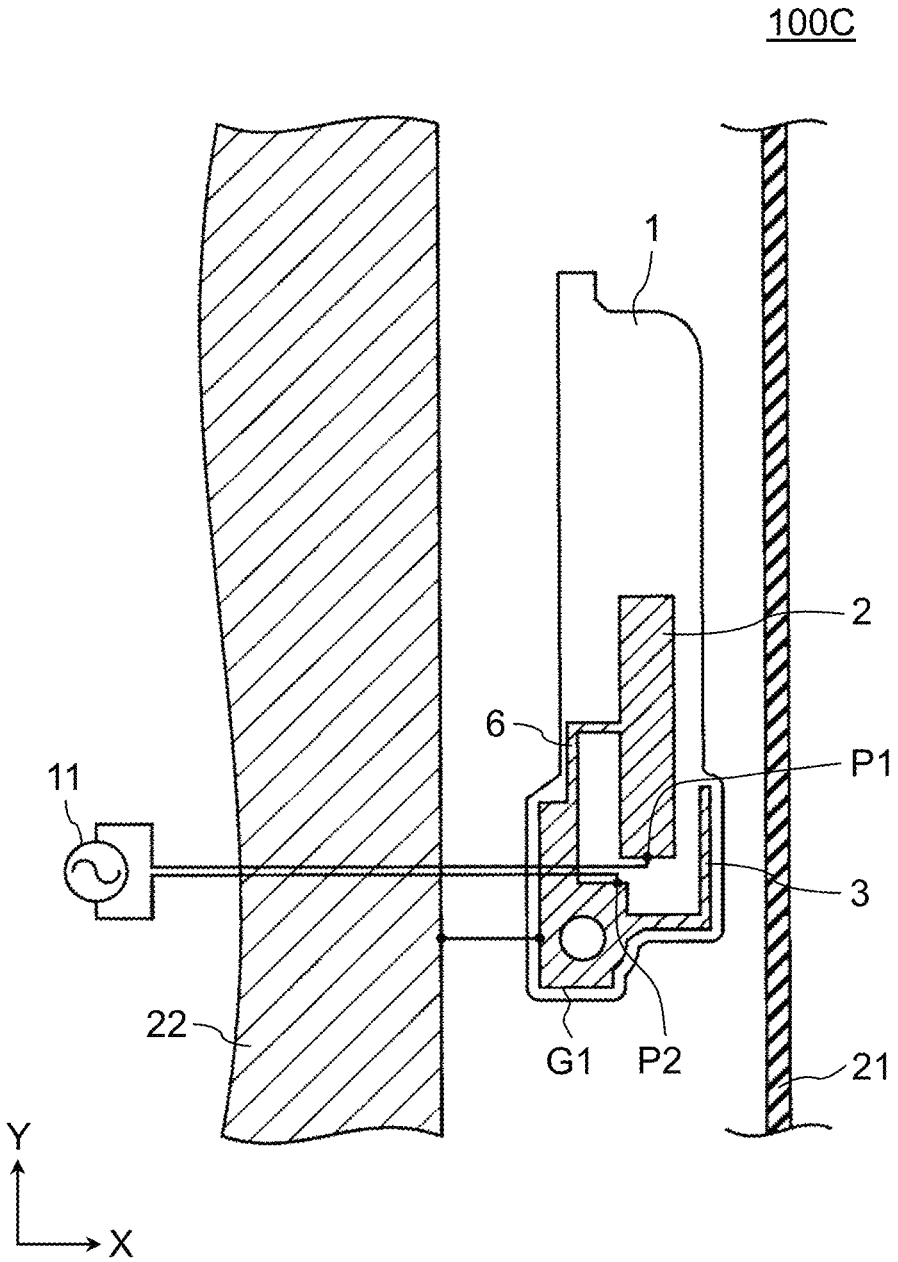
FIG. 12 is a plan view illustrating a configuration of antenna unit 100C according to a fourth exemplary embodiment.

FIG. 12 is a plan view illustrating a configuration of antenna unit 100C according to the fourth exemplary embodiment. Antenna unit 100C includes plate-shaped dielectric substrate 1, as well as antenna element 2, stub element 3, short-circuit conductor 6 and ground conductor G1 that are provided on dielectric substrate 1. Antenna unit 100C is substantially equivalent to antenna unit 100 of FIG. 3 further including short-circuit conductor 6.

Antenna element 2 is connected to ground conductor G1 (i.e. a reference potential) via short-circuit conductor 6 that is disposed near a second edge (at a negative side in the X-direction in FIG. 12) of dielectric substrate 1. This configuration lets antenna unit 100C act as an inverted-F antenna. Generally, in inverted-F antennas, an electric current is apt to crowd on their short-circuit conductor, and this may increase the SAR. However, in antenna unit 100C, short-circuit conductor 6 is disposed between antenna element 2 and metallic chassis 22, and this configuration can reduce the SAR in an area beyond antenna unit 100 in the positive X-direction, especially an area outside outer casing 21.

4-2. Effects and Others

In antenna unit 100C according to the fourth exemplary embodiment, antenna element 2 is connected to the reference potential via short-circuit conductor 6 disposed near the second edge of dielectric substrate 1. This configuration lets antenna unit 100 act as an inverted-F antenna.

Even antenna unit 100C that acts as an inverted-F antenna in the fourth exemplary embodiment can reduce the occurrence of a rise in SAR. In particular, if a tablet-type electronic device includes the antenna unit provided somewhere around a display, the electronic device can reduce the SAR in its lateral direction.

5. Fifth Exemplary Embodiment

Hereinafter, with reference to FIGS. 13 and 14, an electronic device according to a fifth exemplary embodiment will now be described.

5-1. Configuration

Figure 13:
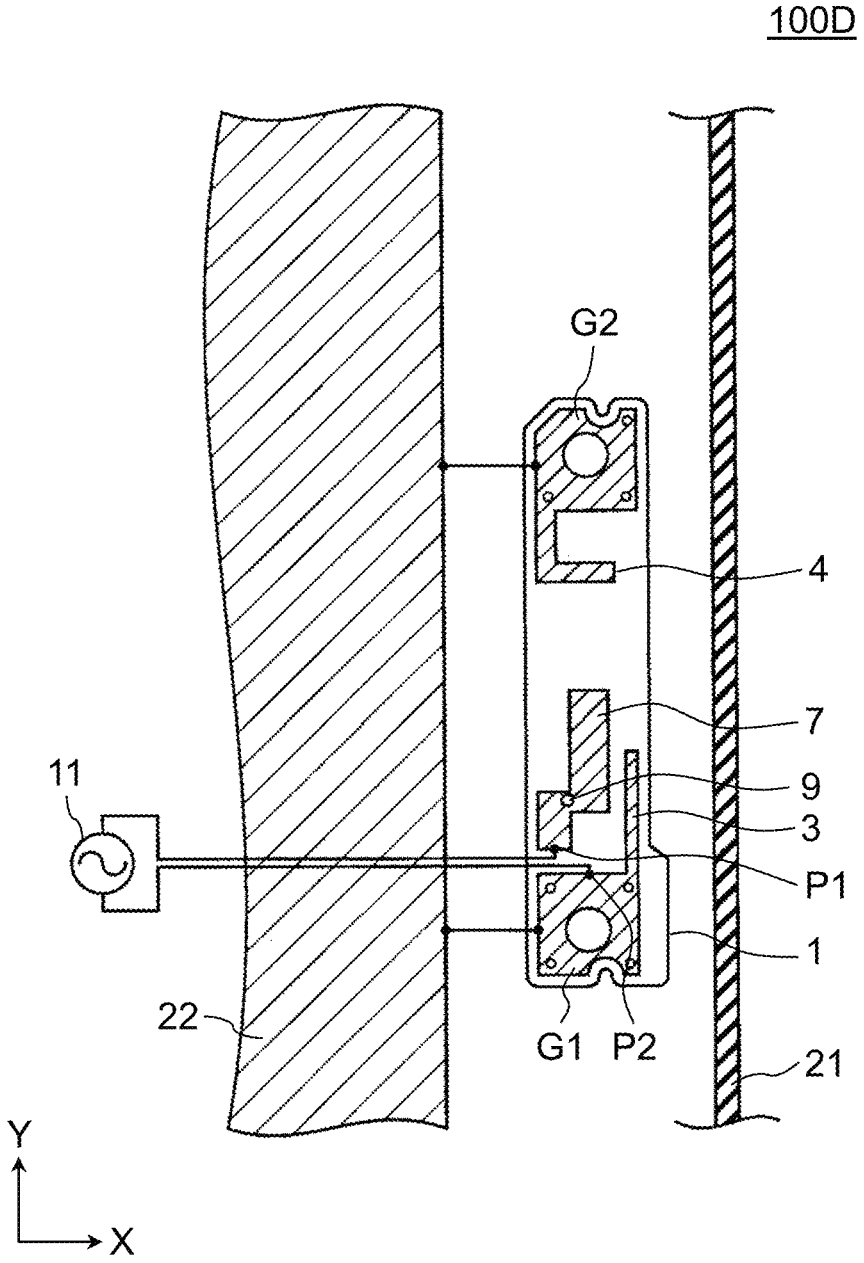
FIG. 13 is a plan view illustrating a configuration of a front side of antenna unit 100D according to a fifth exemplary embodiment.
Figure 14:
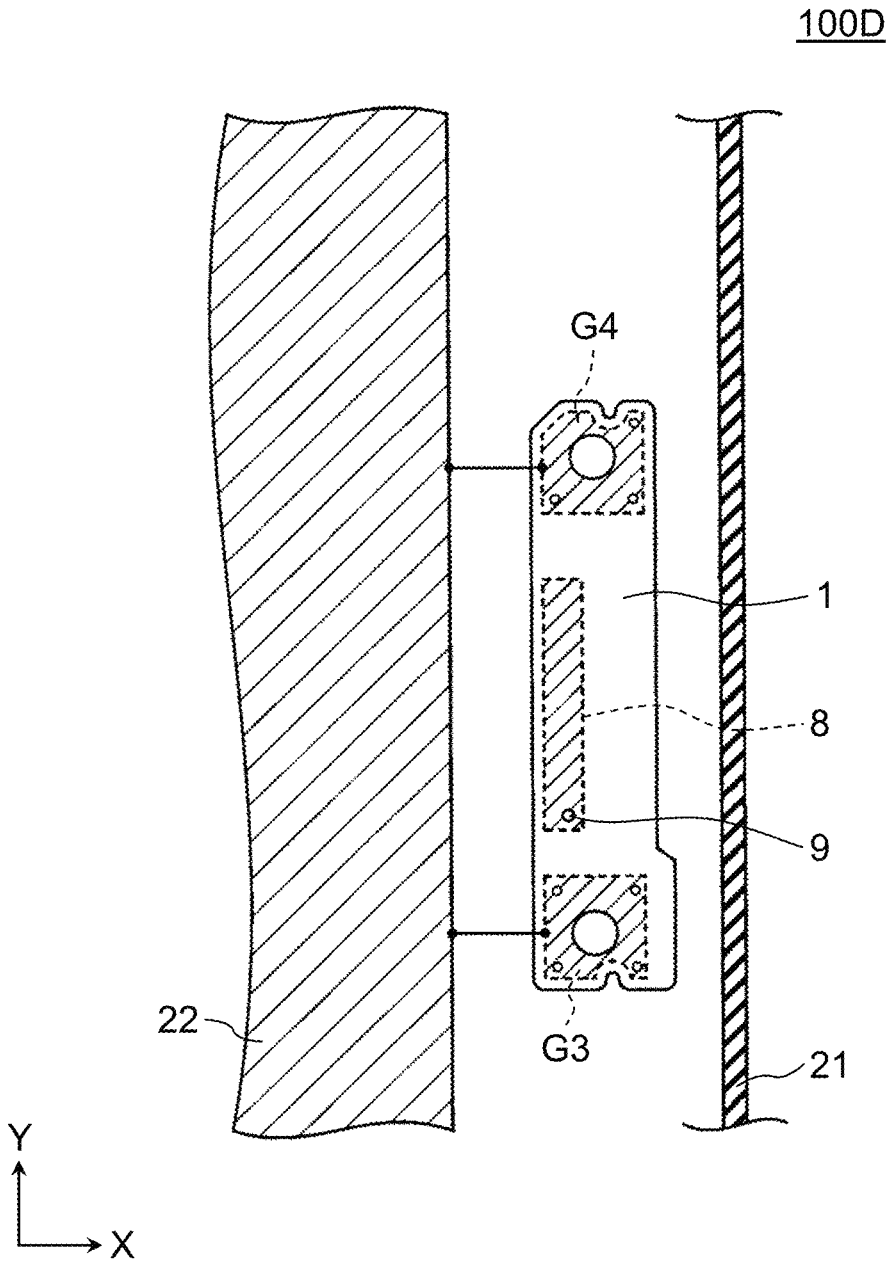
FIG. 14 is a plan view illustrating a configuration of a back side of antenna unit 100D of FIG. 13.

FIG. 13 is a plan view illustrating a configuration of a front side of antenna unit 100D according to the fifth exemplary embodiment. FIG. 14 is a plan view illustrating a configuration of a back side of antenna unit 100D of FIG. 13. Antenna unit 100D includes plate-shaped dielectric substrate 1, as well as stub element 3, ground element 4, antenna element parts 7, 8, via conductor 9, and ground conductors G1 to G4 that are provided on dielectric substrate 1. Antenna unit 100D is substantially equivalent to antenna unit 100A of FIG. 6 including antenna element parts 7, 8 and via conductor 9 as a replacement for antenna element 2 and further including ground conductors G3, G4. In FIG. 14, antenna element part 8 and ground conductors G3, G4 that are formed on a back side of dielectric substrate 1 are indicated with dotted lines.

Dielectric substrate 1 has a first surface (a front side) and a second surface (the back side) that are opposite to each other. In antenna unit 100D, an antenna element includes antenna element part 7 that is provided on the front side of dielectric substrate 1 and designed to resonate at a first resonance frequency and antenna element part 8 that is provided on the back side of dielectric substrate 1 and designed to resonate at a second resonance frequency other than the first resonance frequency. Antenna element parts 7 and 8 are connected to each other through via conductor 9 that passes through dielectric substrate 1. Antenna unit 100D operates on two frequency bands by exciting antenna element part 7 at the first resonance frequency and antenna element part 8 at the second resonance frequency through feedpoint P1.

5-2. Effects and Others

In antenna unit 100D according to the fifth exemplary embodiment, dielectric substrate 1 has the first surface and the second surface that are opposite to each other. In antenna unit 100D, the antenna element includes antenna element part 7 that is provided on the first surface of dielectric substrate 1 and designed to resonate at the first resonance frequency and antenna element part 8 that is provided on the second surface of dielectric substrate 1 and designed to resonate at the second resonance frequency other than the first resonance frequency. Antenna element parts 7 and 8 are connected to each other through via conductor 9 that passes through dielectric substrate 1.

Antenna unit 100D according to the fifth exemplary embodiment can reduce the occurrence of a rise in SAR while operating on two frequency bands.

6. Sixth Exemplary Embodiment

Hereinafter, with reference to FIGS. 15 and 16, an electronic device according to a sixth exemplary embodiment will now be described.

6-1. Configuration

Figure 15:
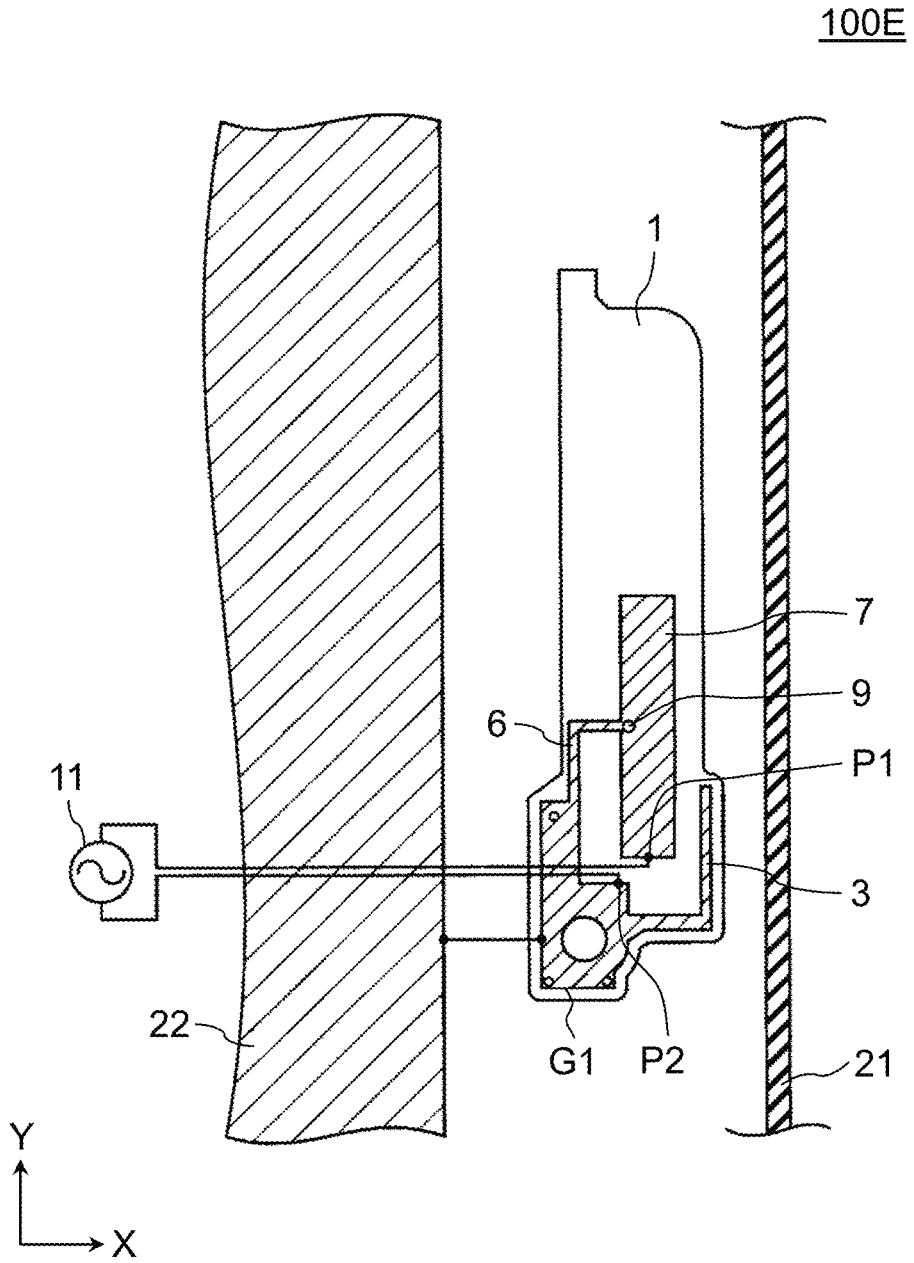
FIG. 15 is a plan view illustrating a configuration of antenna unit 100E according to a sixth exemplary embodiment.
Figure 16:
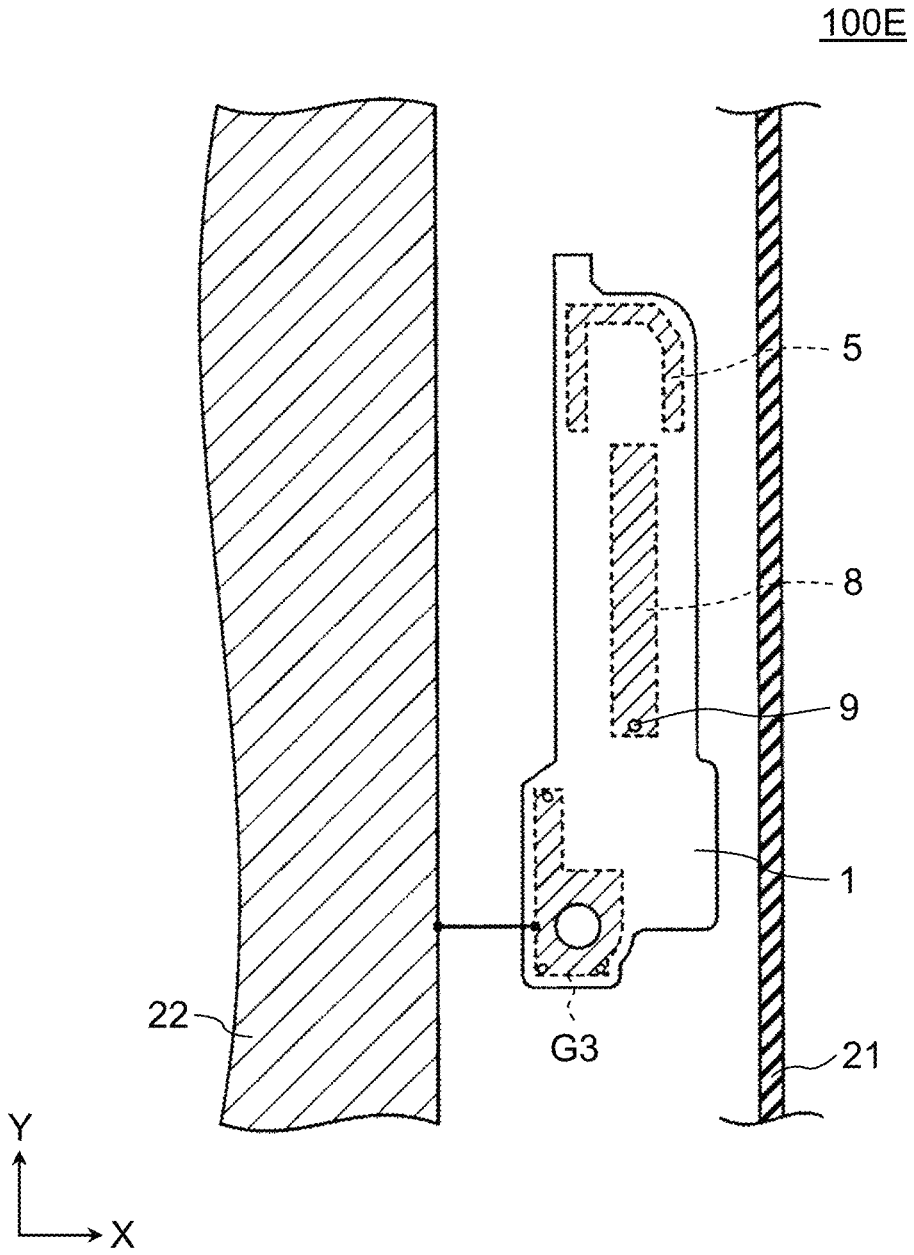
FIG. 16 is a plan view illustrating a configuration of a back side of antenna unit 100E of FIG. 15.

FIG. 15 is a plan view illustrating a configuration of antenna unit 100E according to the sixth exemplary embodiment. FIG. 16 is a plan view illustrating a configuration of a back side of antenna unit 100E of FIG. 15. Antenna unit 100E includes plate-shaped dielectric substrate 1, as well as stub element 3, parasitic element 5, antenna element parts 7, 8, via conductor 9, and ground conductors G1, G3 that are provided on dielectric substrate 1. Antenna unit 100E is substantially equivalent to antenna unit 100B of FIG. 10 including antenna element parts 7, 8 and via conductor 9 as a replacement for antenna element 2 and further including ground conductor G3. In FIG. 16, parasitic element 5, antenna element part 8 and ground conductor G3 that are formed on a back side of dielectric substrate 1 are indicated with dotted lines.

Similarly to antenna unit 100D of FIG. 13, antenna unit 100D operates on two frequency bands by exciting antenna element part 7 at a first resonance frequency and antenna element part 8 at a second resonance frequency through feedpoint P1.

6-2. Effects and Others

Antenna unit 100E according to the sixth exemplary embodiment can reduce the occurrence of a rise in SAR while operating on two frequency bands.

Other Exemplary Embodiments

The first to sixth exemplary embodiments described above are provided to illustrate technologies disclosed in this patent application. Technologies according to the present disclosure, however, can be applied to any variations to which change, replacement, addition, omission, or the like are appropriately made, other than the exemplary embodiments. A new exemplary embodiment can be made by combining some structural elements in any of the first to sixth exemplary embodiments described above.

In light of this, other exemplary embodiments will now be shown.

Two or more of the disclosed exemplary embodiments may be combined. For example, the electronic device in the first exemplary embodiment may include any of antenna units 100A to 100E according to the second to sixth exemplary embodiments.

An electronic device may have one antenna unit, or may have three or more antenna units.

Ground element 4 may vary in shape and disposition other than the shape and disposition of the ground element shown in FIG. 6 and others, with a proviso that at least part of the ground element faces a second end (an open end) of antenna element 2 and is electromagnetically coupled to the second end of antenna element 2. Likewise, parasitic element 5 may vary in shape and disposition other than the shape and disposition of the parasitic element shown in FIG. 10 and others, with a proviso that at least part of the parasitic element faces the second end of antenna element 2 and is electromagnetically coupled to the second end of antenna element 2.

Metallic chassis 22 may be partially exposed to the outside of outer casing 21, other than metallic chassis 22 that is entirely disposed inside outer casing 21. Outer casing 21 and metallic chassis 22 may form any structure, with a proviso that the first edge of dielectric substrate 1 faces outer casing 21 and the second edge of dielectric substrate 1 faces metallic chassis 22.

The exemplary embodiments described above are provided to illustrate technologies according to the present disclosure. For that purpose, the accompanying drawings and detailed description are provided.

Consequently, the accompanying drawings and detailed description provided to illustrate the technologies described above may include structural elements that are not essential for resolving problems as well as those essential for resolving problems. Thus, these non-essential structural elements, if they are included in the accompanying drawings or detailed description, should not be construed as essential structural elements.

Since the exemplary embodiments described above are provided to illustrate technologies according to the present disclosure, various kinds of change, replacement, addition, omission, or the like may be made to these exemplary embodiments without departing from the scope of the claims and equivalents thereof.

INDUSTRIAL APPLICABILITY

An antenna unit according to the present disclosure can operate on multiple bands of frequencies and is very effective among other multiband antennas if the antenna unit is required to operate on a wider range of frequencies. The antenna unit according to the present disclosure can reduce the SAR and readily satisfy SAR-specific regulatory requirements.

REFERENCE MARKS IN THE DRAWINGS

1: dielectric substrate
2: antenna element
3: stub element
4: ground element
5: parasitic element
6: short-circuit conductor
7, 8: antenna element part
9: via conductor
11, 11-1, 11-2: high-frequency signal source
21: outer casing
22: metallic chassis
23: display
100, 100-1, 100-2, 100A to 100E, 200, 200A: antenna unit
G1 to G4: ground conductor
P1: feedpoint
P2: connection point

The invention claimed is:

1. An antenna unit comprising:
a plate-shaped dielectric substrate;
an antenna element provided on the dielectric substrate;
a stub element provided on the dielectric substrate; and
a ground element,
wherein the dielectric substrate has a first edge extending along a longitudinal direction of the dielectric substrate and a second edge extending along the longitudinal direction of the dielectric substrate, the second edge being opposite to the first edge,
wherein the antenna element is disposed along the longitudinal direction of the dielectric substrate and has a first end containing a feedpoint and a second end containing an open end,
wherein the stub element is disposed between a section of the antenna element of a predetermined length containing the first end of the antenna element and the first edge of the dielectric substrate along the longitudinal direction of the dielectric substrate, and the stub element has a first end connected to a reference potential and a second end containing an open end,
wherein the dielectric substrate has a first surface and a second surface that are opposite to each other,
wherein the antenna element includes:
a first antenna element part that is provided on the first surface of the dielectric substrate and designed to resonate at a first resonance frequency; and
a second antenna element part that is provided on the second surface of the dielectric substrate and designed to resonate at a second resonance frequency other than the first resonance frequency,
wherein the first antenna element part and the second antenna element part are connected to each other through a via conductor that passes through the dielectric substrate,
wherein the ground element is provided on the first surface of the dielectric substrate,
wherein the around element has a first end connected to the reference potential and a second end containing an open end,
wherein the ground element has a section of a predetermined length containing the second end of the ground element, and
wherein the section of the ground element faces an open end of the first antenna element part.

2. The antenna unit according to claim 1, wherein the ground element is configured such that the second end of the ground element is closer to the first antenna element part than the first end of the ground element.

3. The antenna unit according to claim 1, further comprising a parasitic element provided on the second surface of the dielectric substrate,
wherein the parasitic element is connected to none of the antenna element, the stub element, nor the reference potential.

4. The antenna unit according to claim 3, wherein the parasitic element has a U-shape.

5. The antenna unit according to claim 4, wherein the parasitic element includes two ends and a middle section between the two ends,
wherein the parasitic element is configured such that the two ends are closer to the second antenna element part than the middle section is.

6. The antenna unit according to claim 1, wherein the section of the ground element is electromagnetically coupled to the open end of the first antenna element part.

7. An antenna unit comprising:
a plate-shaped dielectric substrate;
an antenna element provided on the dielectric substrate;
a stub element provided on the dielectric substrate,
wherein the dielectric substrate has a first edge extending along a longitudinal direction of the dielectric substrate and a second edge extending along the longitudinal direction of the dielectric substrate, the second edge being opposite to the first edge, wherein the antenna element is disposed along the longitudinal direction of the dielectric substrate and has a first end containing a feedpoint and a second end containing an open end, wherein the stub element is disposed between a section of the antenna element of a predetermined length containing the first end of the antenna element and the first edge of the dielectric substrate along the longitudinal direction of the dielectric substrate, and the stub element has a first end connected to a reference potential and a second end containing an open end, wherein the dielectric substrate has a first surface and a second surface that are opposite to each other, wherein the antenna element includes:

a first antenna element part that is provided on the first surface of the dielectric substrate and designed to resonate at a first resonance frequency; and a second antenna element part that is provided on the second surface of the dielectric substrate and designed to resonate at a second resonance frequency other than the first resonance frequency, wherein the first antenna element part and the second antenna element part are connected to each other through a via conductor that passes through the dielectric substrate; and a parasitic element provided on the second surface of the dielectric substrate, wherein the parasitic element is connected to none of the antenna element, the stub element, nor the reference potential.

* * * * *